US008702299B2

(12) United States Patent
Kapila et al.

(10) Patent No.: US 8,702,299 B2
(45) **Date of Patent: *Apr. 22, 2014**

(54) APPARATUS AND METHOD FOR HOMOGENIZING TWO OR MORE FLUIDS OF DIFFERENT DENSITIES

(75) Inventors: Mukesh Kapila, The Woodlands, TX (US); Perry Lomond, Houston, TX (US)

(73) Assignee: M-I L.L.C., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/295,622

(22) Filed: Nov. 14, 2011

(65) Prior Publication Data

US 2012/0063261 A1 Mar. 15, 2012

Related U.S. Application Data

(63) Continuation of application No. 12/783,010, filed on May 19, 2010, now Pat. No. 8,079,751, which is a continuation of application No. 11/224,247, filed on Sep. 12, 2005, now abandoned.

(60) Provisional application No. 60/609,156, filed on Sep. 10, 2004.

(51) Int. Cl.
*B01F 5/06* (2006.01)

(52) U.S. Cl.
USPC ..... 366/158.5; 366/181.5; 366/336; 366/337; 366/340

(58) Field of Classification Search
USPC ..... 366/158.5, 181.5, 336, 337, 340, 341, 366/162.4
See application file for complete search history.

(56) References Cited

U.S. PATENT DOCUMENTS

| | | | | |
|---|---|---|---|---|
| 1,720,247 | A | 7/1929 | Smith | |
| 1,730,453 | A | 10/1929 | Devon | |
| 2,645,463 | A | 7/1953 | Stearns | |
| 3,868,967 | A | 3/1975 | Harding | |
| 3,924,989 | A * | 12/1975 | Althausen et al. | 425/130 |

(Continued)

FOREIGN PATENT DOCUMENTS

| | | | |
|---|---|---|---|
| EP | 0489211 | A1 | 6/1992 |
| EP | 1555256 | A | 7/2005 |
| WO | 00/62915 | A | 10/2000 |

OTHER PUBLICATIONS

European Search Report, issued Mar. 28, 2007 for European Application No. 0525581.0.
Office Action, dated Dec. 24, 2008, for U.S. Appl. No. 11/224,247.
Office Action, dated Jun. 12, 2009, for U.S. Appl. No. 11/224,247.
Office Action, dated Nov. 19, 2009, for U.S. Appl. No. 11/224,247.

*Primary Examiner* — David Sorkin

(57) ABSTRACT

An apparatus for blending two or more fluid streams, wherein a first fluid has a higher density than the other fluids, includes a first fluid director and at least a second fluid director providing fluid communication of a first and second fluid stream, respectively, to a primary mixing chamber. The first fluid director includes one or more baffles to disturb the first fluid stream and to direct it toward a rearward portion of the first inlet to the primary mixing chamber. A secondary blending chamber is in fluid communication with the primary chamber outlet and includes at least one, and preferably two static mixers. When two static mixers are serially retained in the secondary blending chamber, they may be skewed rotationally relative to each other such that the orifice profiles of each static mixer are not in alignment.

21 Claims, 8 Drawing Sheets

(56) References Cited

U.S. PATENT DOCUMENTS

| | | | | |
|---|---|---|---|---|
| 4,498,786 | A | 2/1985 | Ruscheweyh | |
| 5,839,828 | A | 11/1998 | Glanville | |
| 5,865,537 | A | 2/1999 | Streiff et al. | |
| 6,910,797 | B2 * | 6/2005 | Falcon | 366/127 |
| 6,946,011 | B2 | 9/2005 | Snyder | |
| 8,079,751 | B2 * | 12/2011 | Kapila et al. | 366/158.5 |
| 2006/0056271 | A1 | 3/2006 | Kapila | |

* cited by examiner

APPARATUS AND METHOD FOR HOMOGENIZING TWO OR MORE FLUIDS OF DIFFERENT DENSITIES

CROSS REFERENCE TO RELATED APPLICATIONS

This application is a continuation of U.S. application Ser. No. 12/783,010, filed on May 19, 2010, now U.S. Pat. No. 8,079,751 which is a continuation of U.S. application Ser. No. 11/224,247, filed Sep. 12, 2005, now abandoned which in turn claims priority to U.S. Provisional Patent Application No. 60/609,156, filed Sep. 10, 2004 the contents of which are incorporated herein by reference.

BACKGROUND OF INVENTION

When preparing certain types of fluid mixtures, it is sometimes necessary to homogenize two or more fluids having different densities and different rheological properties. It is desired, in some circumstances, that the two or more fluids are blended as they continue to flow downstream.

Traditionally, inline mixing of two or more fluids of different densities requires commingling the fluids, under pressure, in an enclosed space of varying cross-sectional diameter from the inlet lines to the outlet line. The varying cross-sectional diameter creates zones of turbulence and re-circulation, which promotes mixing.

One such prior art method utilizes a series of nozzles through the input lines to create turbulent flow in each of the streams prior to reaching the mixing area. The joined flow then exits the mixing area into the discharge line. However, the turbulent flow in each line dissipates before the mixing area is reached. Further, the denser fluid displaces the less dense fluid and the two fluids continue to flow, separated by a slower boundary layer in which some mixing does occur.

Thus, increasing the areas of turbulence to the denser fluid would significantly improve the mixing of the two fluids. In addition, increasing the areas of turbulence would increase the amount of shearing of the mixed fluid.

SUMMARY

This invention pertains to both an apparatus and a methodology of using that apparatus. The combination of the apparatus and the method work conjointly to improve the homogenization of two or more fluids of different densities and rheological properties through the creation of turbulent flow, shearing and turbulent kinetic energy. The design of the apparatus facilitates and improves the ability to homogenize two or more fluids rapidly while in flow without moving parts or additional energy sources.

Fluid—fluid homogenization occurs based upon the transfer of turbulent kinetic energy and shearing action due to flow distortion and the creation of turbulence. The apparatus creates turbulence and homogenization in three areas: a primary mixing chamber, a secondary blending chamber, and a downstream static mixer.

The higher density fluid is passed through a first fluid director connected to the primary mixing chamber at a precalculated angle. Prior to entering the primary mixing chamber, the higher density fluid is subjected to turbulence and redirection of its flow path due to semi-circular baffles placed in its flow line. A lighter density fluid is concurrently added to the primary mixing chamber through a second fluid director, also at a precalculated angle.

The lighter density fluid flow changes the direction of the higher density fluid flow into the primary mixing chamber and reduces the higher density fluid velocity such that large eddy currents with the lower density fluid are created. The flows of the higher and lower density fluids are combined in the primary mixing chamber, wherein the decreased volume, as compared to the combined volume of the first and second fluid directors, discharges and accelerates the fluid, thereby changing the direction of flow.

The combined flow continues to the secondary mixing area, wherein there may be two static mixers in series, having shaped orifices offset from each other in the plane of the combined flow. Upon exiting the second static mixer, large eddy currents provide enhanced mixing, shearing and transfer of turbulent kinetic energy for effective homogenization.

In a first claimed embodiment, an inline blending apparatus includes a primary mixing chamber for mixing a plurality of fluids, wherein the first fluid has a density greater than the second fluid. The primary mixing chamber has a plurality of fluid inlets and a primary chamber outlet. A first fluid inlet is defined by an inlet edge having a forward portion located toward the primary chamber outlet and a rearward portion located distal the primary chamber outlet. A first fluid director provides fluid communication of the first fluid to the primary mixing chamber. A plurality of baffles are affixed within the first fluid director to introduce turbulence and shear into the flow as well as to direct the flow toward the rearward portion of the inlet edge. A second fluid director provides unimpeded fluid communication of a second, less dense fluid to the primary mixing chamber.

The first and second fluids, forming a mixed primary fluid flow in the primary mixing chamber, exit through the primary chamber outlet to a secondary blending chamber. Retained within the secondary blending chamber is at least one static mixer. As the mixed primary fluid flows through the secondary blending chamber, the static mixer provides additional blending of the two fluids.

Other aspects and advantages of the claimed subject matter will be apparent from the following description and the appended claims.

DETAILED DESCRIPTION

Figure 1:
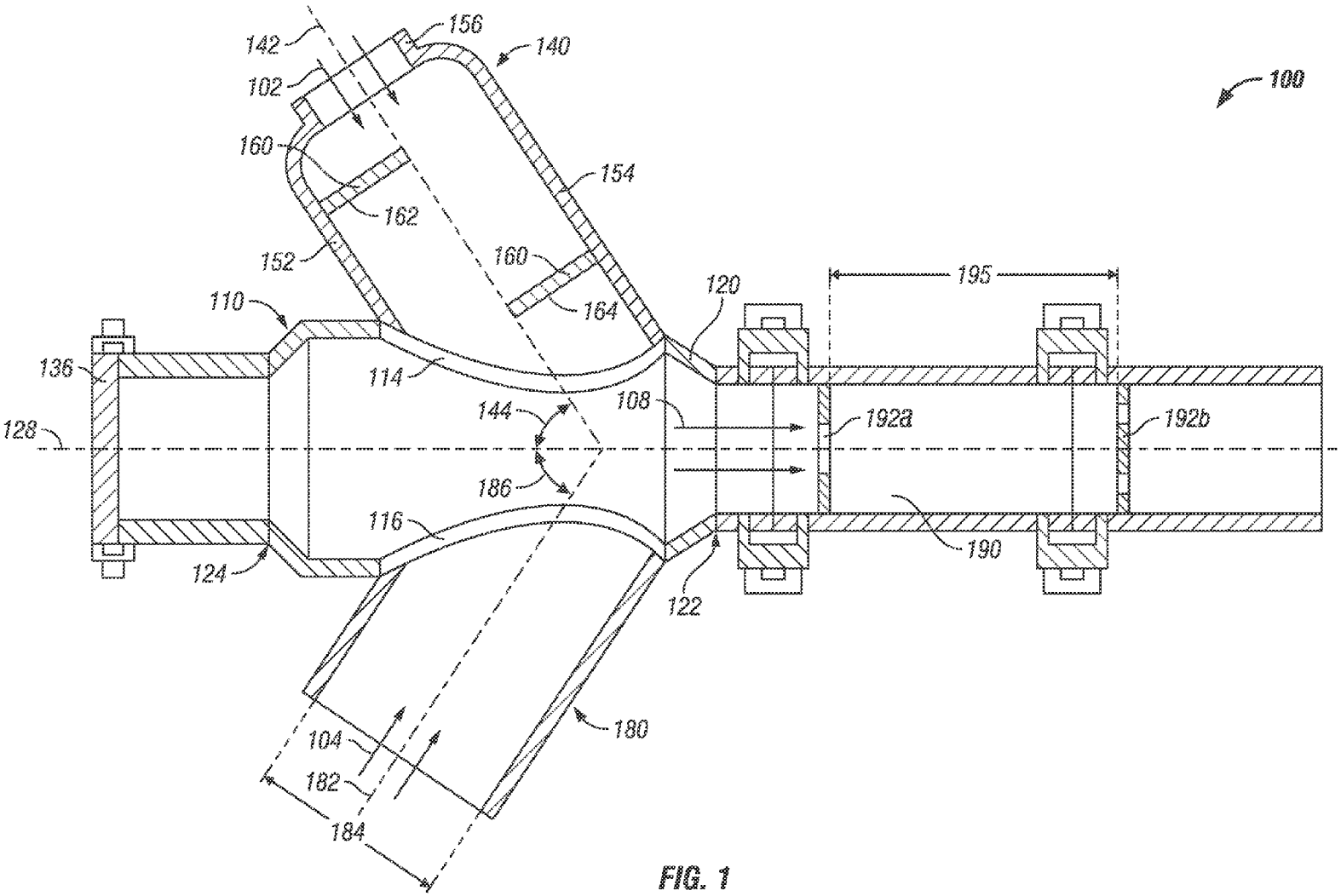
FIG. 1 depicts a cross sectional top view of the inline blending apparatus.

Depicted in FIG. 1 is an inline blending apparatus 100 for blending two or more fluid streams, wherein the fluids have different densities and different rheological properties.

Throughout this disclosure, a first fluid stream 102 refers to the stream of fluid having a higher density than any other fluid that is individually introduced to the inline blending apparatus 100.

The inline blending apparatus 100 includes a primary mixing chamber 110, a first fluid director 140, a second fluid director 180, and a secondary blending chamber 190. The first fluid director 140 provides the first fluid stream 102 to the primary mixing chamber 110 while the second fluid director 180 provides a second fluid stream 104 to the primary mixing chamber 110. The secondary blending chamber 190 receives a mixed primary fluid stream 108 from the primary mixing chamber 110 and further blends the mixed primary fluid stream 108.

Figure 2:
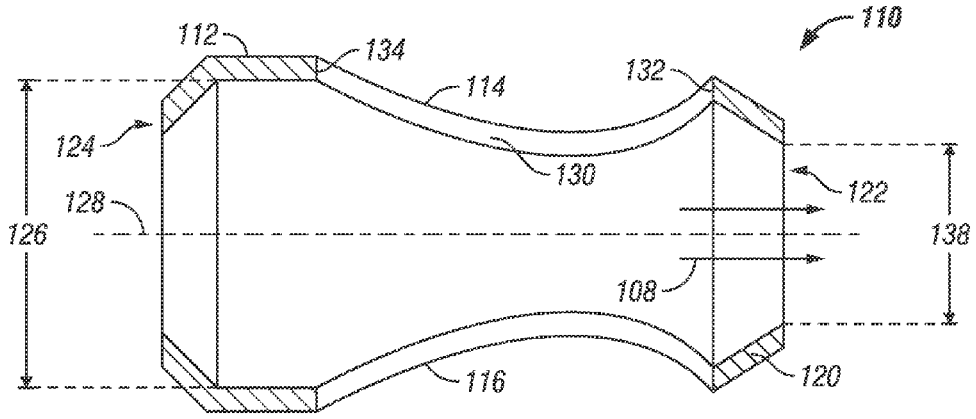
FIG. 2 is a cross sectional top view of the primary mixing chamber.

Referring to FIG. 2, the primary mixing chamber 110 is defined by a chamber wall 112 having two or more orifices therethrough to provide first inlet 114 and second inlet 116. Preferably, the primary mixing chamber 110 is cylindrical about a primary axis 128 with the chamber wall 112 extending between an upstream end 124 and a downstream end 122. The primary mixing chamber 110 has a primary chamber diameter 126 and a chamber volume.

The primary chamber outlet 120 is located at the downstream end 122 of the primary mixing chamber 110 and is generally symmetrical about the primary axis 128. The primary chamber outlet 120 has a primary outlet diameter 138 that is less than the primary chamber diameter 126. Thus, the velocity of flow from the primary mixing chamber 110 is accelerated as it passes through the primary chamber outlet 120.

Figure 8:
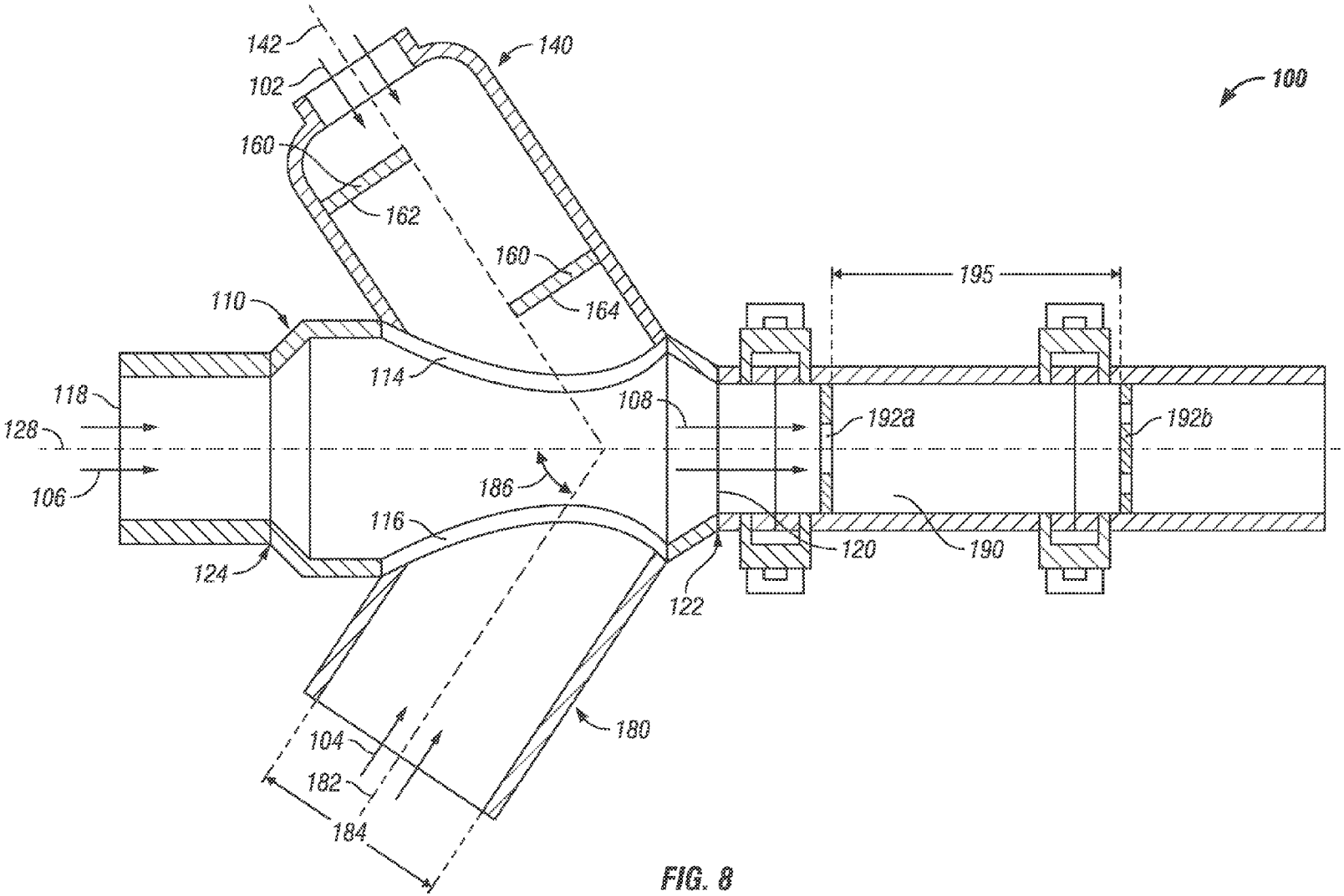
FIG. 8 is a cross sectional view of an embodiment of the inline blending apparatus.

The first and second inlets 114, 116 are located through the chamber wall 112, each being generally perpendicular to the primary chamber outlet 120. The second inlet 116 is preferably located on side of the primary axis 128 opposite of the first inlet 114 and is of similar size. When desired, a third inlet 118 may be located at the upstream end 124 of the primary mixing chamber 110, as shown in FIG. 8. If a third fluid stream 106 is not desired, the third inlet 118 may be enclosed by a cover 136, as shown in FIG. 1

Referring again to FIG. 2, the first inlet 114 is defined by an inlet edge 130 in the chamber wall 112. As the first inlet 114 is generally perpendicular to the primary chamber outlet 120, the inlet edge 130 has a forward portion 132, which is closest to the primary chamber outlet 120. The inlet edge 130 also has a rearward portion 134, which is farthest from the primary chamber outlet 120.

Referring again to FIG. 1, the first fluid director 140 provides the first fluid stream 102 to the primary mixing chamber 110 through the first inlet 114. The first fluid director 140 may be thought of as having a centrally located first director axis 142. The directional difference between the first director axis 142 and the primary axis 128, as measured upstream from the intersection of the axes 128, 142, defines a first director angle 144.

Figure 3:
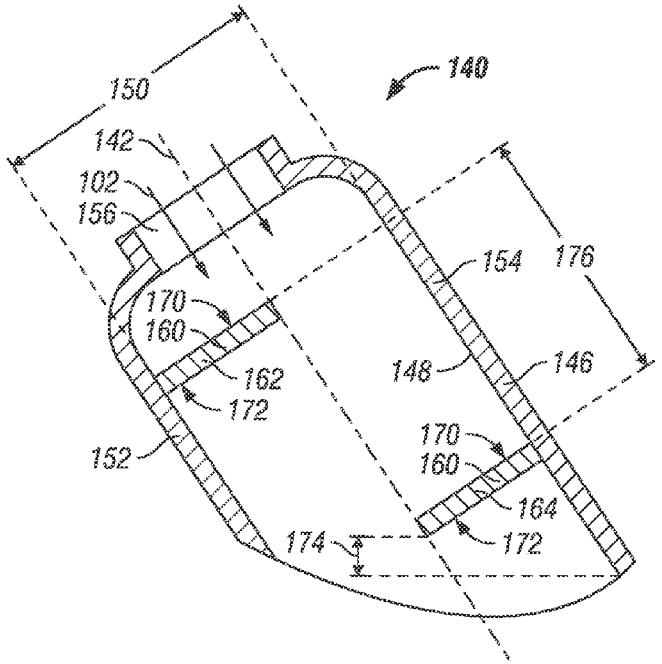
FIG. 3 is a cross sectional top view of the first fluid director.

Referring to FIG. 3, the first fluid director 140 has a first director wall 146 with an inner surface 148. The first fluid director 140 is preferably generally cylindrical about the first director axis 142 and has a first director diameter 150 and first director volume. The first director diameter 150 is less than the diameter of the line feeding the primary fluid stream 102 into the first fluid director 140.

The first director wall 146 has a rearward wall section 152 and a forward wall section 154. Although the rearward and forward wall sections 152, 154 are not separable sections, the rearward wall section 152 is affixed to the primary mixing chamber 110 near the rearward portion 134 of the first inlet 114 and the forward wall section 154 adjoins the primary mixing chamber 110 near the forward portion 132 of the first inlet 114.

As may be seen in FIGS. 1 and 3, the first director diameter 150 is greater than that of the inlet line 156 from which the first fluid stream 102 flows. A plurality of baffles 160 designed to redirect the first fluid stream 102 as well as to create turbulence and shear in the stream 102 are affixed to the inner surface 148 of the first fluid director 140.

Figure 4:
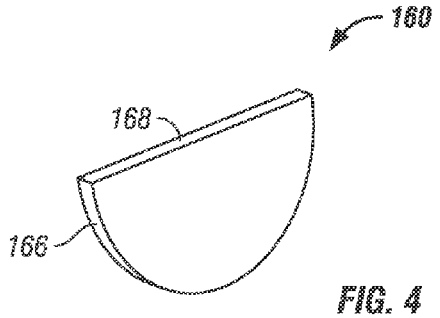
FIG. 4 is a perspective view of an embodiment of a baffle.

Referring to FIGS. 3 and 4, in a first embodiment of the first fluid director 140, an upstream baffle 162 and a downstream baffle 164 each have a cross sectional area sufficient to redirect the first fluid stream 102. In the embodiment shown, each baffle 162, 164 has a semi-circular shape, with a round connection edge 166 affixed to the inner surface 148 perpendicular to the first director wall 146 and a linear baffle edge 168 extending into the flow area of the first fluid director 140. Both the upstream and downstream baffles 162, 164 have an upstream surface 170, which faces upstream. The upstream surface 170 of each of the upstream and downstream baffles 162, 164 has a surface area that is half of the cross sectional area of the first fluid director 140. Thus, each baffle 162, 164 has a baffle surface area equal to half of the cross sectional area of the first fluid director.

The upstream baffle 162 and the downstream baffle 164 are positioned such that the baffle edges 168 are generally parallel to each other with the connection edges 166 affixed to the inner surface 148 on opposing sides of the first director axis 142. The upstream baffle 162 is affixed to the rearward wall section 152 while the downstream baffle 164 is affixed to the forward wall section 154. The downstream baffle 164 is located along the inner surface 148 such that when the first fluid director 140 is attached to the primary mixing chamber 110, its baffle edge 168 is upstream from the first inlet 114 by an offset distance 174 sufficient to direct the first fluid stream 102 through the first inlet 114 near the rearward portion 134 and to create a mixing area of eddy current within the first fluid director 140 adjacent the downstream surface 172. This mixing area is also located within a portion of the primary mixing chamber 110.

The upstream baffle 162 is located a baffle distance 176 upstream from the downstream baffle 164. The baffle distance 176 should be sufficient for the first fluid stream 102, redirected by the upstream baffle 162 toward the downstream baffle 164, to maintain turbulent flow. The baffle distance 176 depends, in part, upon the density of the fluid in the first fluid stream 102. Thus, the baffle distance 176 for one fluid may be different than for a different fluid having a different density.

Figure 5:
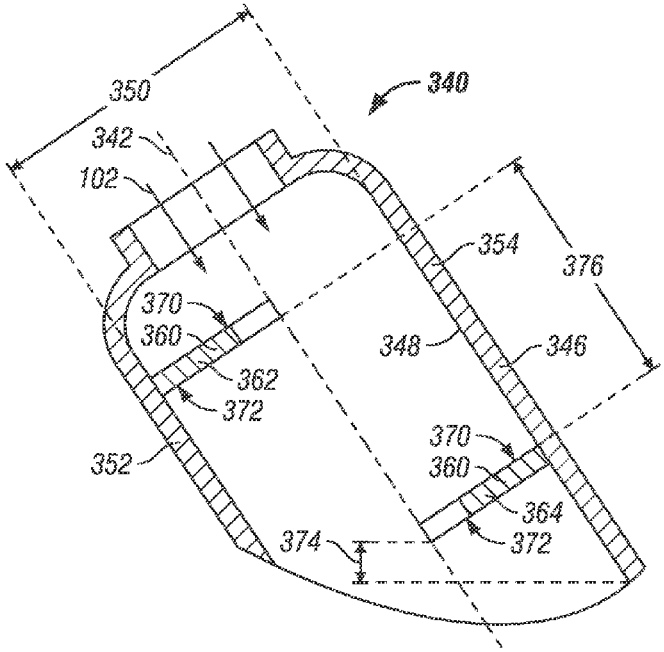
FIG. 5 is a cross sectional top view of an embodiment of a baffle in the first fluid director.
Figure 6:
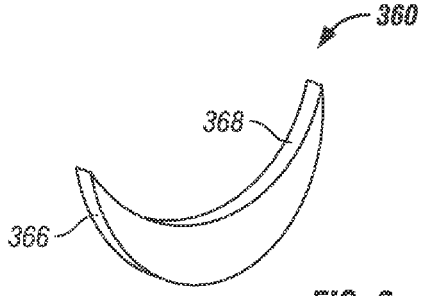
FIG. 6 is a perspective view of an embodiment of a baffle.

In an alternative embodiment, shown in FIGS. 5 and 6, each baffle 360 has a baffle edge 368 recessed toward the connection edge 366. This configuration may be desirable for first fluid streams 102, wherein the first fluid has a very high density.

Figure 7:
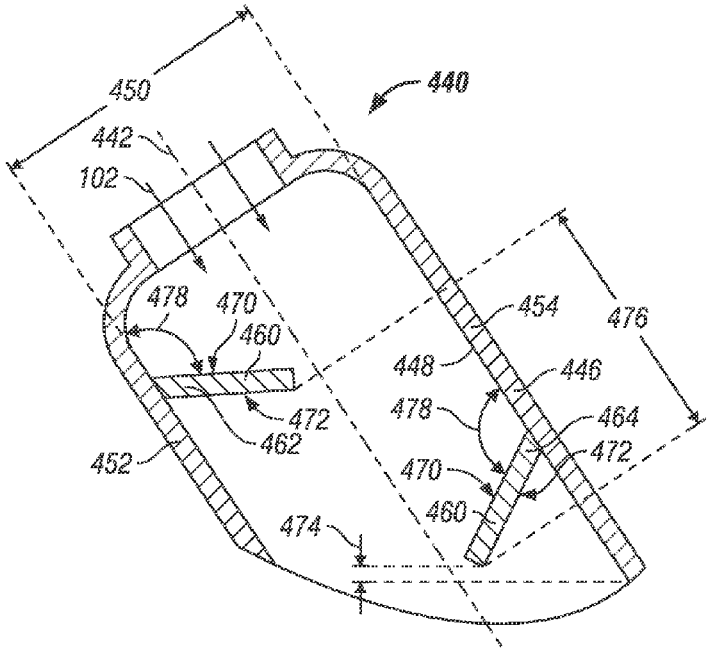
FIG. 7 is a cross sectional top view of an alternative baffle position embodiment within the first fluid director.

In an alternative embodiment shown in FIG. 7, each baffle 460 is affixed to the inner surface 448 so that the upstream surface 470 forms an obtuse angle 478 with the inner surface 448.

Referring to FIGS. 1 and 8, the second fluid director 180 is generally cylindrical about a second director axis 182 and has a second director diameter 184. The second director axis 182 defines a second director angle 186 with the primary axis 128. The second director angle 186 is preferably equal to the first director angle 144. The second director diameter 184 is greater than that of the second inlet line 188 from which the second fluid stream emerges and may be equal to the first director diameter 150.

The second fluid director 180 has a second director volume. When added to the volume of the first director, the total volume is greater than the primary chamber volume. This net volume decrease experienced by the first and second fluid streams 102, 104 inside the primary mixing chamber 110 facilitates mixing of the fluid streams 102, 104 into a mixed primary fluid stream 108.

Figure 9:
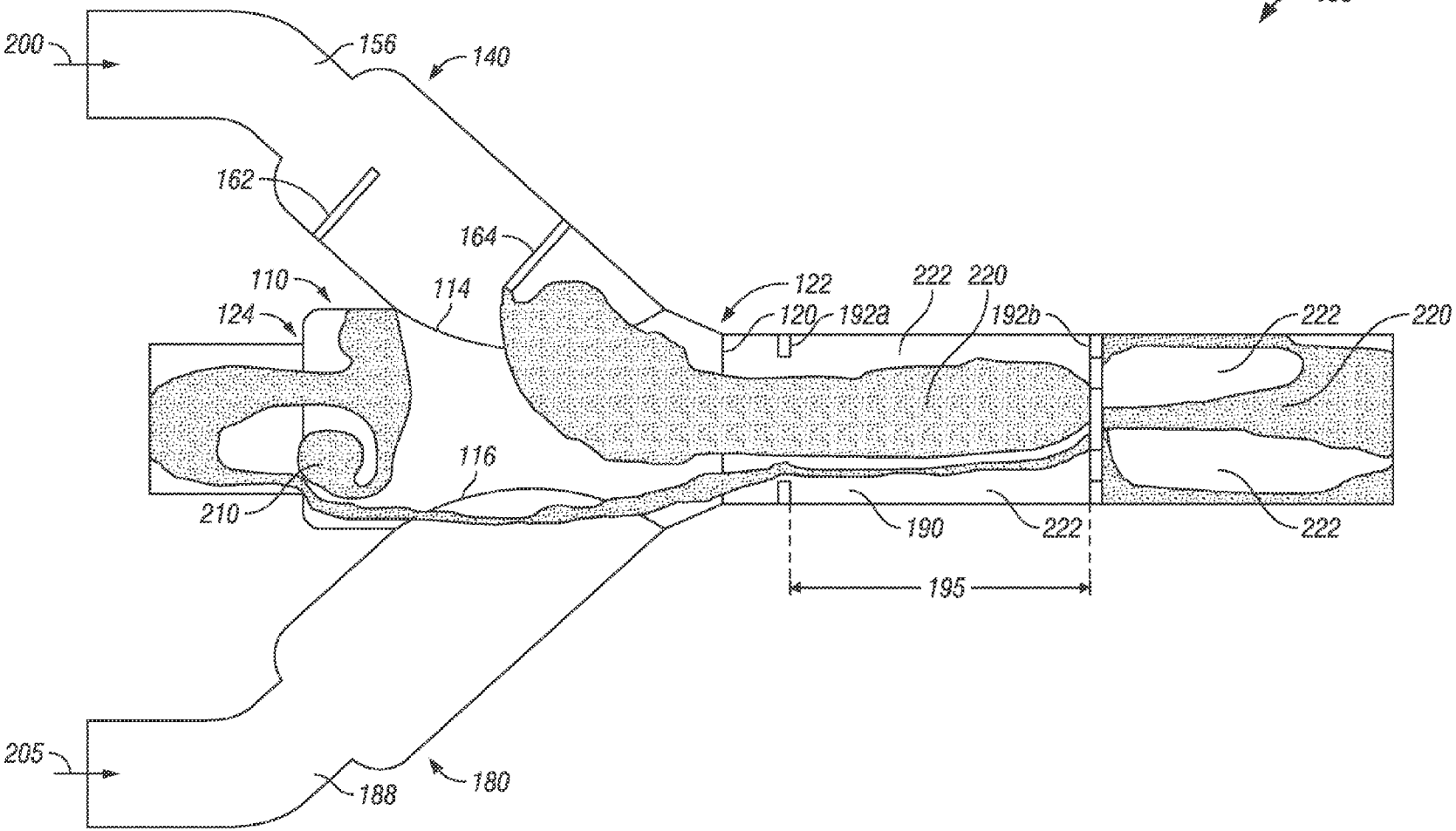
FIG. 9 is a cross sectional top view of a flow model of two fluids being homogenized in the inline blending apparatus.

Referring to FIG. 9, the secondary blending chamber 190 is depicted. The secondary blending chamber 190 is cylindrical and coaxially aligned with the primary mixing chamber 110. To further blend the mixed primary fluid stream 108, at least one static mixer 192 is retained within the secondary blending chamber 190. To obtain a well-homogenized stream from the mixed primary fluid stream 108, two static mixers 192*a*, 192*b* may be retained within the secondary blending chamber 190.

Figure 11:
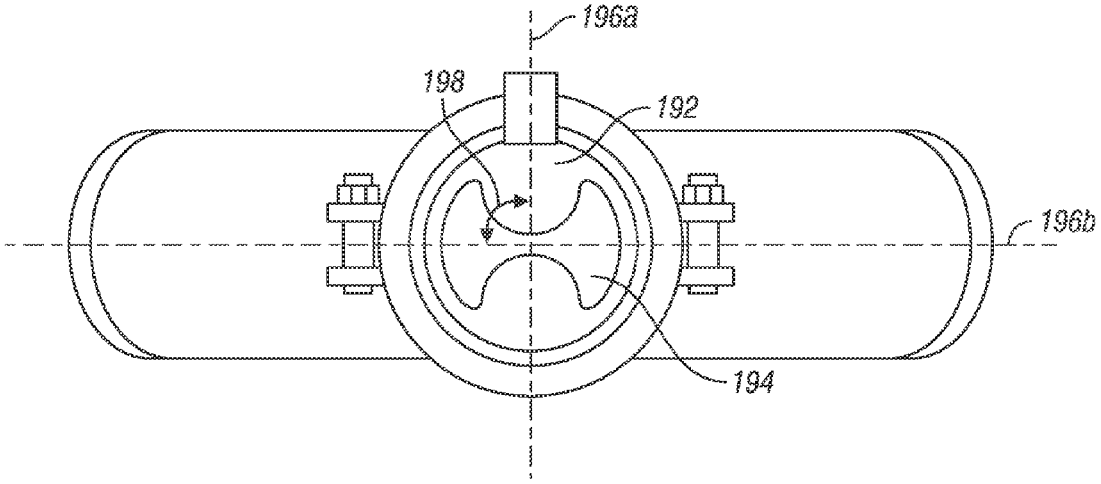
FIG. 11 (Prior Art)
FIG. 11 is a front view of a static mixer.

The static mixer 192 is a disk-like device, as depicted in FIG. 11, having a specifically-shaped orifice 194 through which the mixed primary fluid stream 108 flows. The orifice 194 is shaped to induce turbulence and further blend the components of the mixed primary fluid stream 108. The profile of the orifice 194 may be evenly symmetrical about one or more axes of symmetry 196*a*, 196*b*. When more than one axis of symmetry 196 exists for a particular profile of an orifice 194, a symmetry angle 198 is defined between each axis of symmetry 196*a*, 196*b*.

Figure 12:
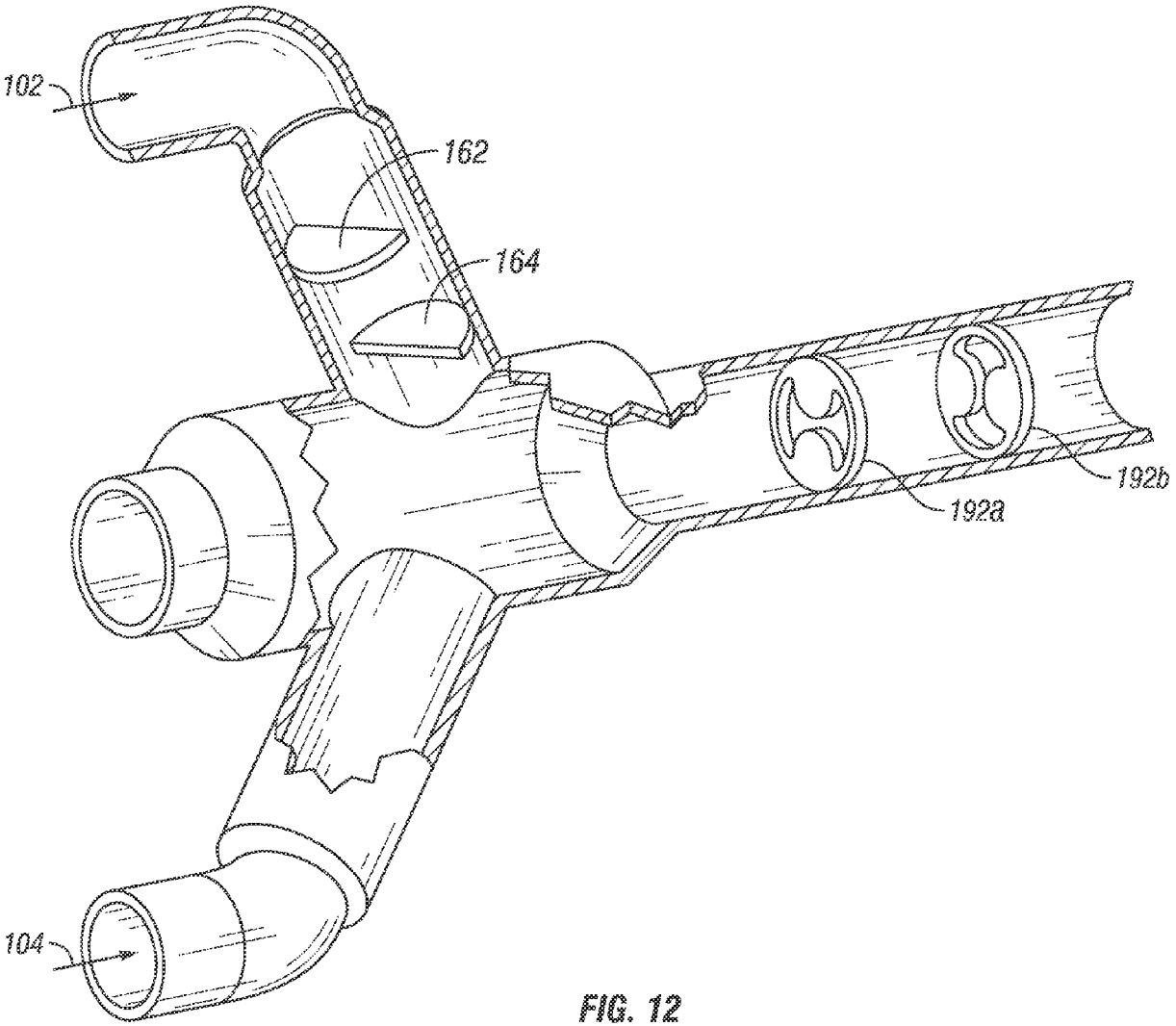
FIG. 12 is a perspective translucent view of the inline blending apparatus.

When two static mixers 192*a*, 192*b* having a similar orifice 194 profile are used and the profile of the orifice 194 has two or more axes of symmetry 196*a*, 196*b*, a first static mixer 192*a* may be rotationally offset from a second static mixer 192*b* by an amount equal to the symmetry angle 198 of the orifice 194 profile. This offset may be seen in FIG. 12. By offsetting the profile of the orifice 194 of the second static mixer 192*b*, the faster-moving part of the fluid stream exiting the first static mixer 192*a*, may be slowed by the offset of the second static mixer 192*b*, providing further homogenization.

If the first and second static mixers 192*a*, 192*b* are too close together, the combined effect will be as if there were only one static mixer 192, as the as-of-yet unmixed portion of the fluid stream will not have ample space to further blend. Thus, first and second static mixers 192*a*, 192*b* should have a separation distance 195 between them sufficient for both static mixers 192*a*, 192*b* to act in concert to blend the mixed primary fluid stream 108.

Although there are several types of static mixers on the market, the best results have been achieved with the static mixers produced by Westfall, Inc. and disclosed in U.S. Pat. No. 5,839,828, which have a pair of opposed flaps extending inward from the outer flange and inclined in the direction of flow (not shown). A front view of such a static mixer is depicted in FIG. 11.

Example

Figure 10:
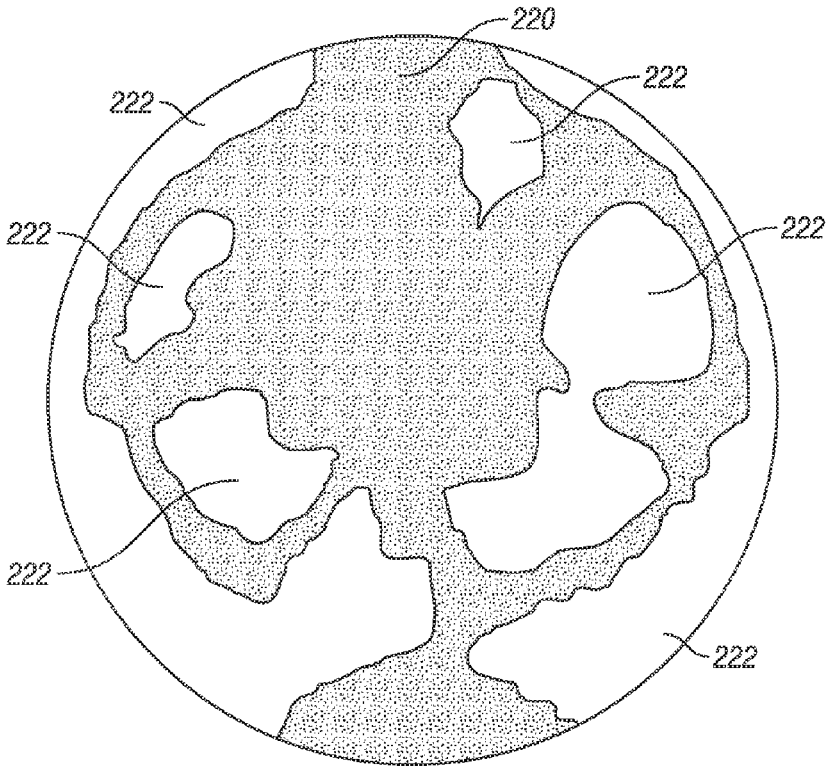
FIG. 10 is a cross sectional view of a model of a blended fluid flow downstream of a second static mixer.

The homogenization of a barite and bentonite fluid and a brine fluid was modeled through the inline blending apparatus 100 as described. FIGS. 9 and 10 depict different views of the blending contours of the two fluids.

The barite—bentonite fluid has a higher density than the brine fluid, and is thus introduced through the first fluid director 140. The upstream baffle 162 has a semicircular profile with a surface area that is half of the cross-sectional area of the first fluid director 140. The upstream baffle 162 is affixed to the rearward wall portion 152 of the first fluid director 140 such that the upstream surface 170 is perpendicular to the direction of flow. The upstream baffle 162 induces turbulence to the barite-bentonite fluid stream 200 and directs it toward the downstream baffle 164.

The downstream baffle 164 is affixed to the forward wall portion 154 of the first fluid director 140 such that the upstream surface 170 is perpendicular to the inner surface 148 of the first director wall 146. The baffle distance 176 is approximately equal to the first director diameter 150. As can be seen in FIG. 9, the downstream baffle 164 directs the barite-bentonite fluid stream 200 into the primary mixing chamber 110 near the rearward portion 134 of the first inlet 114.

The brine fluid stream 205, being of a lesser density than the barite—bentonite fluid stream 200, was introduced through the second fluid director 180. No third fluid was introduced to the primary mixing chamber 110.

The low-density brine fluid stream 205 readily flowed into the primary mixing chamber 110. The high-density barite-bentonite fluid stream 200 flowed through the brine fluid stream 205, nearly to the second inlet 116. A thin boundary layer of effectively mixed fluid 220 developed near the second inlet 116. An eddy 210 near the upstream end 124 of the primary mixing chamber 110 caused mixing of the two fluids streams 200, 205. Between the downstream baffle 164 and the downstream end 122 of the primary mixing chamber 110, the barite-bentonite fluid stream 200 and the brine fluid stream 205 mixed to form an area of effectively mixed fluid 220.

The area of effectively mixed fluid 220 along with area of ineffectively mixed fluid 222 or unmixed barite-bentonite fluid stream 200 and brine fluid stream 205 continued through the primary chamber outlet 120 to the secondary blending chamber 190 and through the first static mixer 192*a*. It may be noted that the higher density barite-bentonite fluid stream 200 displaced the brine fluid stream 205 and entered the secondary blending chamber 190 along the side farthest from the first inlet 114.

The static mixers 192*a*, 192*b* used in the secondary blending chamber 190 were of the type previously described as being sold by Westfall. Upon traversing through the first static mixer 192*a*, only a thin stream of barite-bentonite fluid 200 remained unmixed in the center plane depicted in FIG. 9. The outer edges of the fluid in the secondary blending chamber 190 between the first and second static mixers 192*a*, 192*b* were unmixed brine fluid stream 205 or areas of ineffectively mixed fluid 222. The center portion of the fluid stream was an area of effectively mixed fluid 220.

Because the static mixers 192*a*, 192*b* used had two axes of symmetry (as shown in FIG. 11), the second static mixer 192*b* was retained in the secondary blending chamber 190 such that it had a 90 degree offset angle from the first static mixer 192*a*. This accounts for the relatively smaller cross sectional area of the first static mixer 192*a* as compared to the second static mixer 192*b*.

Upon exiting the second static mixer 192*b*, the barite-bentonite fluid stream 200 in the plane modeled had been mixed with the brine fluid stream 205 to at least some extent. Referring to FIG. 10, a cross sectional view of the mixed stream exiting the second static mixer 192*b* is depicted. It may be noted that, although areas of ineffectively mixed fluid 222 remained, there are no areas where an unmixed barite-bentonite stream 200 remained. Further, much of the center area is an area of effectively mixed fluid 220.

Figure 13:
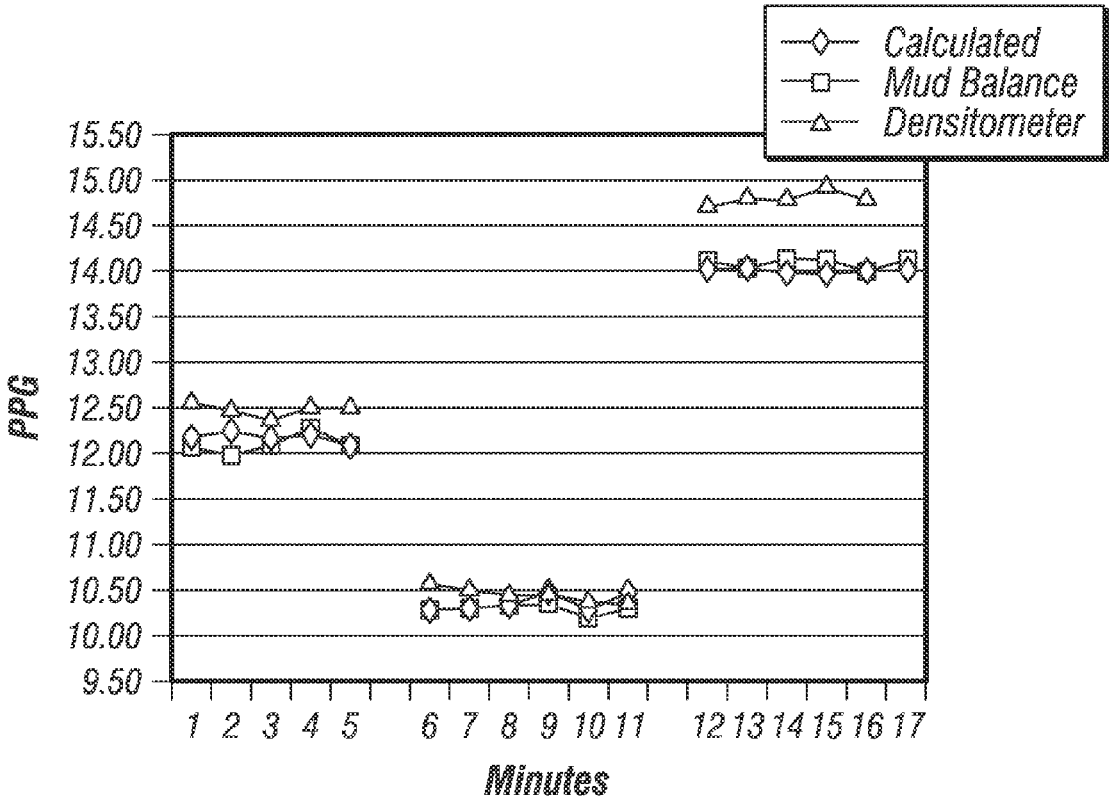
FIG. 13 is a chart comparing measured and calculated cut back at various flow rates.

The accuracy of the model was then tested in a prototype inline blending apparatus 100. The results appear in FIG. 13, which graphically shows the cut back at various flow rates, both calculated and measured. From the graph, it can be seen that the results as measured with a mud balance are very close to the calculated results. The different results obtained with the densitometer were due to equipment calibration.

It is understood that variations may be made in the foregoing without departing from the scope of the invention. For example, the present invention is not limited to the mixing of barite-bentonite fluid with brine fluid, but is equally applicable to any application involving the mixing of fluid flows wherein a first fluid has a higher density than a second or third fluid.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. An apparatus comprising:

a first fluid director providing a first fluid stream having a first density, the first fluid director comprising a plurality of baffles affixed therein to create turbulence in the first fluid stream;

a second fluid director providing unimpeded fluid communication of a second fluid stream having a second density, the first density being greater than the second density;

a primary mixing chamber receiving the first fluid stream from the first fluid director and the second fluid stream from the second fluid director, wherein the first fluid stream and the second fluid stream are mixed in the primary mixing chamber to form a mixed primary fluid stream; and a secondary mixing chamber coaxially aligned with and receiving the mixed primary fluid stream from the primary mixing chamber, wherein the secondary mixing chamber comprises two static mixers in series, wherein each of the two static mixers include an orifice offset from each other in a lane of flow of the mixed primary fluid stream.

2. The apparatus of claim 1 further comprising:

a third fluid director providing a third fluid stream to the primary mixing chamber.

3. The apparatus of claim 2, wherein the third fluid director is located at an upstream end of the primary mixing chamber.

4. The apparatus of claim 1, wherein the primary mixing chamber has a primary chamber diameter, the primary mixing chamber comprising a primary chamber outlet located downstream of the primary mixing chamber, the primary chamber outlet having a primary outlet diameter that is less than the primary chamber diameter.

5. The apparatus of claim 1, wherein the first fluid director is generally cylindrical about the first director axis and the second fluid director is generally cylindrical about the second director axis.

6. The apparatus of claim 1, wherein the first fluid director has a first director diameter, the first fluid director including a line feeding the first fluid stream into the first fluid director, the diameter of the line feeding the first fluid stream is less than the first director diameter.

7. The apparatus of claim 1, wherein the plurality of baffles comprise at least one baffle affixed to opposing sides of an inner surface of the first fluid director.

8. The apparatus of claim 7, wherein the at least one baffle forms an obtuse angle with the inner surface of the first fluid director.

9. An apparatus for blending at least two fluid streams, the apparatus comprising:

a first fluid director providing a first fluid stream having a first density, the first fluid director comprising a plurality of baffles affixed therein to create turbulence in the first fluid stream;

a second fluid director providing unimpeded fluid communication of a second fluid stream having a second density, the first density being greater than the second density;

a primary mixing chamber receiving the first fluid stream from the first fluid director and the second fluid stream from the second fluid director, wherein the first fluid stream and the second fluid stream are mixed in the primary mixing chamber to form a mixed primary fluid stream; and a secondary mixing chamber coaxially aligned with and receiving the mixed primary fluid stream from the primary mixing chamber, wherein the secondary mixing chamber comprises:

a first static mixer; and a second static mixer downstream from the first static mixer, wherein the first static mixer and the second static mixer each comprise an orifice having an orifice profile, and the orifice profile of the first static mixer is oriented 90 degrees from the orifice profile of the second static mixer.

10. The apparatus of claim 9 further comprising:

a third fluid director providing a third fluid stream to the primary mixing chamber.

11. The apparatus of claim 10, wherein the third fluid director is located at an upstream end of the primary mixing chamber.

12. The apparatus of claim 9, wherein the primary mixing chamber has a primary chamber diameter, the primary mixing chamber comprising a primary chamber outlet located downstream of the primary mixing chamber, the primary chamber outlet having a primary outlet diameter that is less than the primary chamber diameter.

13. The apparatus of claim 9, wherein the first fluid director is generally cylindrical about the first director axis and the second fluid director is generally cylindrical about the second director axis.

14. The apparatus of claim 9, wherein the first fluid director having a first director diameter, the first fluid director including a line feeding the first fluid stream into the first fluid director, the diameter of the line feeding the first fluid stream is less than the first director diameter.

15. The apparatus of claim 9, wherein the plurality of baffles comprise at least one semicircular baffle.

16. The apparatus of claim 15, wherein the at least one semicircular baffle has a baffle edge recessed toward a connection edge for contacting the at least one semicircular baffle with an inner surface of the first fluid director.

17. The apparatus of claim 9, wherein the plurality of baffles comprise at least one baffle affixed to opposing sides of an inner surface of the first fluid director.

18. The apparatus of claim 17, wherein the at least one baffle forms an obtuse angle with the inner surface of the fluid director.

19. An apparatus comprising:

a first fluid director providing a first fluid stream having a first density, the first fluid director comprising a plurality of baffles affixed therein to create turbulence in the first fluid stream;

a second fluid director providing unimpeded fluid communication of a second fluid stream having a second density, the first density being greater than the second density; and a primary mixing chamber receiving the first fluid stream from the first fluid director and the second fluid stream from the second fluid director, wherein the first fluid stream and the second fluid stream are mixed in the primary mixing chamber to form a mixed primary fluid stream, wherein the plurality of baffles comprise at least one semicircular baffle.

20. The apparatus of claim 19, wherein the plurality of baffles comprise at east one baffle affixed to opposing sides of an inner surface of the first fluid director.

21. The apparatus of claim 19, wherein the at least one semicircular baffle has a baffle edge recessed toward a connection edge for contacting the at least one semicircular baffle with an inner surface of the first fluid director.

* * * * *